US005564162A

United States Patent [19]

Adjas

[11] Patent Number: 5,564,162

[45] Date of Patent: Oct. 15, 1996

[54] BOOT TREE WITH COMPRESSIBLE LINKS

[76] Inventor: Nabil Adjas, 22 rue Laurent Fauchier, 13100 Aix en Provence, France

[21] Appl. No.: 408,043

[22] Filed: Mar. 21, 1995

[30] Foreign Application Priority Data

Mar. 22, 1994 [FR] France ..... 94 03626

[51] Int. Cl.[6] ..... A43D 5/00; A43D 3/00

[52] U.S. Cl. ..... 12/128 R; 12/115.6

[58] Field of Search ..... 12/114.2, 115.6, 12/115.8, 116.2, 116.4, 116.6, 116.8, 117.2, 117.4, 128 C, 128 R

[56] References Cited

U.S. PATENT DOCUMENTS

| | | | |
|---|---|---|---|
| 501,133 | 7/1893 | Clark | 12/128 R X |
| 642,728 | 2/1900 | Stevens | 12/115.6 X |
| 730,475 | 6/1903 | Riedifer | 12/115.6 X |
| 2,025,173 | 12/1935 | Meyer | 12/116.6 X |
| 2,467,237 | 4/1949 | Sherman et al. | 12/128 R X |

FOREIGN PATENT DOCUMENTS

| | | | |
|---|---|---|---|
| 229463 | 2/1893 | France | 12/128 R |
| 136305 | 3/1901 | Germany . | |
| 620965 | 10/1935 | Germany . | |
| 3803598 | 8/1989 | Germany . | |
| 111874 | 10/1989 | Germany . | |
| 17651 | 4/1910 | United Kingdom . | |
| 1501629 | 2/1978 | United Kingdom . | |

*Primary Examiner*—B. Dayoan
*Attorney, Agent, or Firm*—Browdy and Neimark

[57] ABSTRACT

A boot tree has three shaped pieces: a foot piece, a front leg piece, and a back leg piece. The three pieces are mechanically connected together. The mechanical connections do not contain any hinge connecting one piece to another. The mechanical connection of the foot piece to the front leg piece contains at least one articulated compressible linking element allowing relative pivoting, backwards and forwards, of the two pieces. The leg piece has no obstacle to obstruct the pivoting of the linking element between the positions of the foot when resting and when pointed. The mechanical connection of the front leg piece to the back leg piece also contains at least one articulated compressible linking element, allowing the back leg piece to pivot upwards relative to the front leg piece. The leg pieces have no obstacles which could obstruct the pivoting of the linking element between the positions with the heel in the natural position and with the heel in the raised position.

11 Claims, 15 Drawing Sheets

FIG. 2
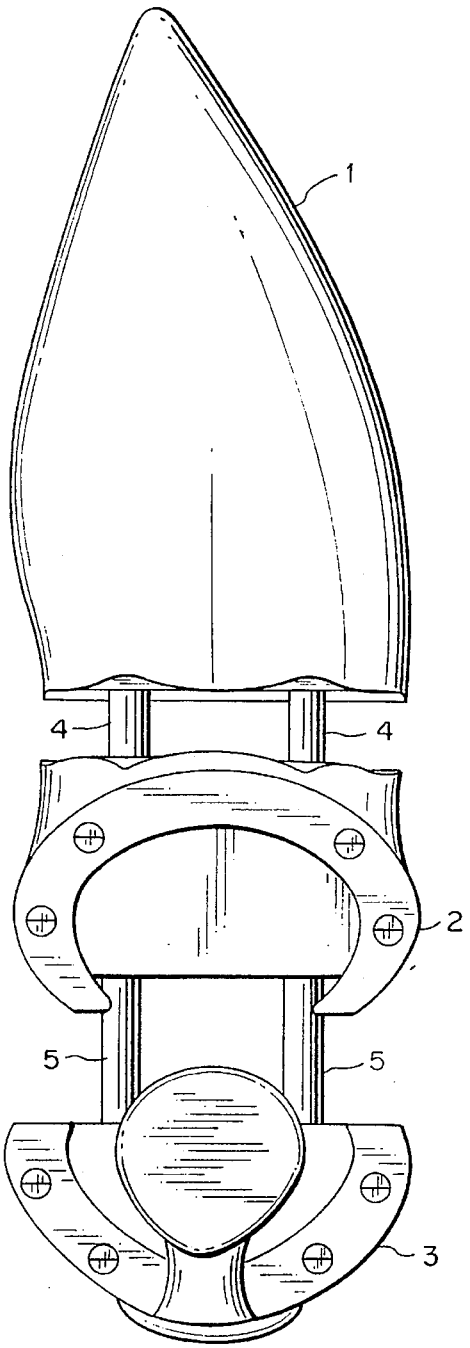
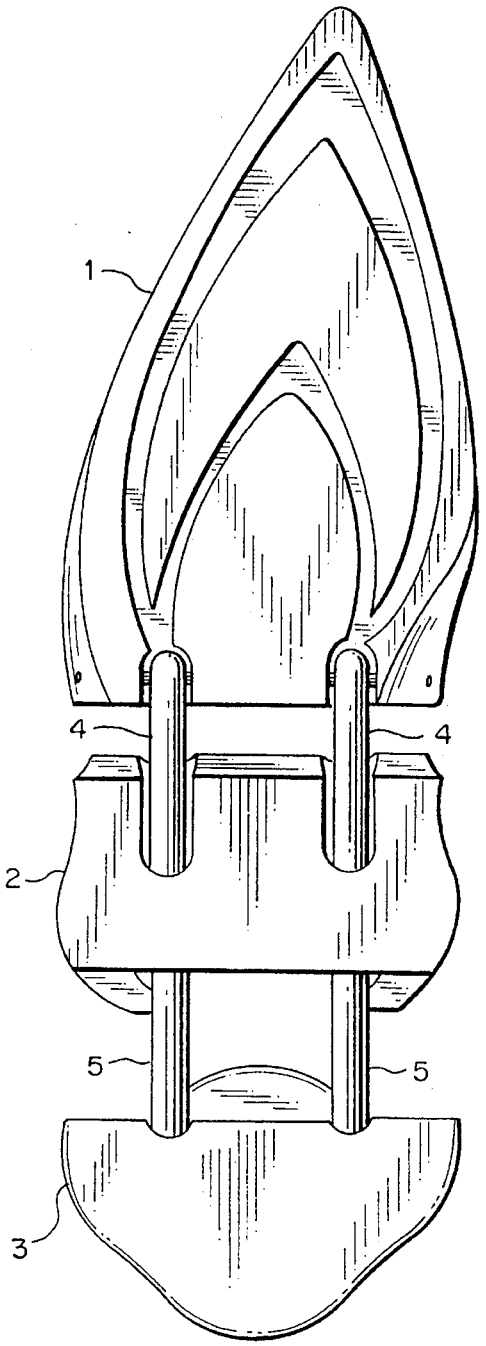
FIG. 3

BOOT TREE WITH COMPRESSIBLE LINKS

FIELD OF THE INVENTION

The present invention relates to a boot tree.

REVIEW OF THE PRIOR ART

As for shoes, it is desirable to effectively protect boots from damage caused by folds in the leather and, in part, to bring a firm tension from their vamps to their legs.

The vamp is the part of the boot surrounding the foot, and the leg is the part which is above the foot and which surrounds the leg. Although the prior art has a protective effect, it should be stated that it is complicated, imperfect and in particular not sufficiently adapted to the requirements of the styles of boots with bevelled heels such as so-called cowboy boots. The fixed hinge of DE-A-136,305 is labeled "c" in FIG. 2, which shows that the hinge acts as a single pivot point between two tree elements, and is not a link which has two pivot points.

For example DE-A-136,305 describes a boot tree for which the introduction possibilities are limited on account of the existence of a fixed hinge on the foot and whose design is such that if the tension increases above the calf, it decreases below the leg.

DE-A-620,965 describes a boot tree comprising two shaped pieces, mechanically connected together, and a third, totally autonomous, piece for the back of the leg. The front leg piece comprises a flexible parallelogram one side of which is mechanically connected to the articulated foot piece by a hinge vis-à-vis the front leg piece. These devices are complicated and cannot be adapted to several leg sizes or circumferences.

SUMMARY OF THE INVENTION

According to the present invention, these problems and others are resolved by boot trees constituted by three shaped pieces, namely pieces largely following the shape of the boot, articulating to provide ease of operation, of use and of assembly and the required effectiveness.

The first shaped piece, called hereafter "foot piece" is located in the area of the vamp, the second piece, namely the front leg piece, provides by its central position the covering of the front side of the leg, its curved supporting base being situated on the arch of the boot and the third piece or "back leg piece" is positioned from the heel of the boot to the back side of said leg. The surfaces of these two last-named pieces, due to their high, rounded and splayed lines, cover a large area, preferably at least half and notably two thirds of the area of the leg, and thus contribute to the straightness of the latter.

A more particular subject of the present invention is a boot tree for boots comprising three shaped pieces mechanically connected together, namely a foot piece, connected to a front leg piece, itself connected to a back leg piece, characterized in that said mechanical connections do not contain any hinge connecting one piece to another, that is, the pieces or main elements of the boot tree are not connected by a single-pivot device ("hinge") which allows only relative rotation about the pivot, the mechanical connection of the foot piece to the front leg piece contains at least one articulated compressible linking element, having more than one pivot, said linking element thus allowing the relative pivoting backwards and forwards of the two pieces, the leg piece having no material obstacle which could obstruct the pivoting of the linking element in order to allow the above relative pivoting between the positions of the foot when resting and when pointed, the mechanical connection of the front leg piece to the back leg piece contains at least one articulated compressible linking element, said linking element thus allowing the back leg piece to pivot upwards relative to the front leg piece, the leg pieces having no material obstacles which could obstruct the pivoting of the linking element, in order to allow the above relative pivoting between the positions with the heel in the natural position and with the heel in the raised position.

The absence, amongst the mechanical connections, of hinges connecting one piece to the other allows not only the rotation of the above pieces relative to each other, but also allows them to be farther apart or closer together.

By "compressible" element is meant an element such as a spring, whose length relative to an extended position can be reduced by exerting a force on said element. By "articulated" is meant that this element can in addition pivot, as around an axis.

The articulated compressible element can be or can contain for example a spring, a rubber or elastomer tube, an arrangement of hydraulic tubes.

In the case of a piece containing a spring, or a compressible rubber or elastomer element, or also a hydraulic arrangement, pivoting can be obtained quite particularly due to a pivot shaft situated at the end of the said linking element.

The absence of material obstacles which could obstruct the pivoting of the said linking elements allows the above relative pivoting between the positions of the foot when resting and when pointed.

In the case where for example the front leg piece is made of solid wood, it is necessary for example to hollow it out towards the bottom, as will be seen hereafter in the examples, so that the pivoting of the linking element or of the additional articulation elements thus obtained is not hampered.

In the case where it is desired to produce a cheap model, for example of plastic, in order to minimize the quantities of material, the leg piece could have an essentially hollow semi-cylindrical form, plastic fingers being able to be provided from this tube and including at their end space for a shaft for example intended to receive the shaft of a linking element. In such a case, there is in effect essentially a hollow space inside the shaped piece, the fingers being positioned so as not to obstruct the above pivoting.

The same applies for the front leg and the back leg which are also connected by at least one compressible linking element of the type indicated above.

In certain cases, for example in the case where the linking element is constituted essentially by a spring, in order to avoid unnecessary displacement, in all directions, of the foot relative to the leg piece or of the back leg piece relative to the front leg piece, the boot tree according to the invention can in addition include a device suitable for limiting or preventing relative pivoting in the left or right direction in order essentially to retain the pivoting in the upwards and downwards direction. Thus for example the foot retains a normal physiological direction relative to a human foot.

This device is of any known type, for example sliding, piston-forming tubes, hollow-blade guided by a shaft between two walls, etc. Of course no material obstacle must obstruct the pivoting movement.

In certain cases, in particular in the case where simple springs are used to produce the mechanical connections mentioned above, during the removal of the boot tree from a boot a very significant traction would be exerted on the said devices. This is why under preferred conditions for using the above boot tree, the latter has a protuberance on the inside of one leg piece, cooperating with a cavity of complementary shape on the inside of the other leg piece when the back leg piece is in the raised heel position and at the end of relative rotation upwards, in the manner of a hook, so that an upwards traction on the back leg piece fastens the front leg piece without a traction being exerted via the mechanical connections or via the device suitable for limiting or preventing the relative pivoting in the left-right direction of the two leg pieces.

The protuberance can be for example in the form of a finger, or a hook.

Thus, when it is desired to remove the boot tree, the compressible linking element situated between the front leg piece and the back leg piece is compressed, firstly only the back leg piece is displaced and this, by rotation, both rises and approaches the front leg piece, as far as a stop, for example constituted by the sides of the front and back leg pieces which are themselves in the case of a shaped piece, entirely semi-tubular and solid.

At this moment, the protuberance has been introduced into a cavity of complementary shape provided in the other leg piece, and thus the two previously-mentioned pieces fasten together, the hook, namely the protuberance as such being able to be situated either on the front leg piece or on the back leg piece. Preferably this protuberance has a generally blunt shape in order to avoid the person handling the boot tree injuring himself. Thus, when one continues pulling the back leg piece upwards, the traction is not exerted on the compressible linking element but through the hook, avoiding damage to or in this way sparing the previously-described linking element or the other possible articulation elements. The protuberance is preferably situated in the upper half of a leg piece. If the protuberance and the cavity have a function during removal of the boot tree, these elements can also have a function during the introduction of the boot tree into the boot.

In fact, under preferred conditions for using the invention, the face of the protuberance forming a hook opposite that producing the coupling is inclined towards the heel. Thus, during the introduction of the boot tree into the boot, when one presses on the back leg piece, the top part of the cavity comes to rest on the inclined side of the protuberance and thus facilitates the separation of the two leg pieces from each other. If such an effect can be obtained by providing the protuberance with a downwardly-inclined side, it is also possible to provide the cavity with an inclined side cooperating with the protuberance. Thus, when the two inclined sides rest on each other, they naturally separate the two leg pieces and thus also facilitate the relative pivoting of the said two leg pieces.

The articulated compressible linking elements according to the invention can take various forms. In their most simple form, the linking elements are constituted only by springs, for example a spring situated between the foot piece and the front leg piece and a spring situated at the level of the back leg piece. It acts both as a compressible element and an articulation element.

In order to avoid any abnormal extension of the springs during the removal of the boot tree, it is therefore preferable in addition to provide devices limiting the distance between the pieces and therefore the elongation of the spring. In their most simple form, these devices can be for example constituted by simple links or straps, of a determined length such that it corresponds to the maximum extension capacity of a compressible linking element, so that there is no free jolting of one piece relative to another. On the other hand, such flexible links do not hamper the compression of the compressible linking element during the introduction of the boot tree according to the invention into a boot. These devices on the other hand only slightly limit and do not prevent the relative pivoting in the left-right direction between the pieces.

This is why the flexible links can take the form of rigid links, for example of piston or sliding type or of restrained articulation type cooperating with shafts provided on the different shaped pieces.

Under the preferred embodiment conditions, the device suitable for preventing or limiting relative pivoting in the left-right direction of the pieces and the linking element also allowing upward pivoting between the pieces are one and the same element.

There can be mentioned for example a piston fitted with a guide, such that the two tubes of the said piston cannot turn relative to each other, the ends of the pistons being maintained by shafts in their respective places.

Under quite preferable implementation conditions, the said piece is constituted by a tubular element crossed at one of its ends by a transversal shaft fixed on one leg piece, containing at its opposite end two opposed longitudinal slits, diametrically opposed in the case of a tube of circular section, crossed by a second tranversal shaft fixed on the other leg piece, a compressible element such as a spring being placed in the tubular element between the two shafts, the length of the slits thus determining the extreme extended positions of the compressible element, and the said compressible element thus separating the shaped pieces from each other in order to put them in contact with the surfaces of the boot when the boot tree is in place, and thus to tension these surfaces. The tubular element can have any shape, but preferably has a cylindrical shape.

The compressible element can be any compressible element mentioned above such as a hydraulic, rubber or elastomer compressible element and preferably a spring.

Taking into account the fact that the two slits through which the shaft passes are opposite each other in the tube, the relative movements of the pieces are limited to forward-and-back displacements corresponding to the bringing together or separation of the pieces as well as to the upwards-downwards rotation.

There can be provided for example a linking element between the foot piece and the front leg piece as well as a single element between the front leg piece and the back leg piece.

However, under preferred conditions, the leg pieces contain a linking element situated near the top of the said pieces and another linking element situated near the bottom of the said pieces.

Under other preferred implementation conditions, these linking elements are in tandem, that is to say they are found two by two.

Under quite advantageous embodiment conditions, the boot tree according to the invention contains three pairs of articulated compressible linking elements, namely one pair between the foot piece and the front leg piece and two pairs between the front leg piece and the back leg piece.

In order to store the boot trees according to the invention in the minimum amount of space, it should be possible to be able to arrange the foot piece under the leg pieces. This is why, under other preferred implementation conditions, the front leg piece and the back leg piece do not have any material obstacles to the backwards and forwards pivoting of the linking element, such that the foot piece can pivot under the leg.

As has already been seen, it is possible either to provide hollows in a solid piece, for example of solid wood, or in the case where generally tubular leg pieces are used, it is sufficient to provide fingers serving as anchoring points for the shafts used for the linking pieces in positions such that they do not hamper the movements detailed above. In order to facilitate the return of the foot piece during the introduction of the boot tree into the boot, abutment surfaces could then be provided in particular behind the foot piece and in front of the front leg piece since the surface of the leg piece can push the foot piece.

In order to facilitate the placement and the removal of the boot tree according to the invention, there can be provided for example a hook, a loop or a handpiece which can take for example the usual forms of walking-stick knobs, positioned on top of the back leg piece.

The boot trees according to the invention can be used as follows:

Taking account of the large gap between the shaped pieces in the resting position, outside a boot, with the compressible elements unextended, it is important for the introduction phase into the boot to position the shaped pieces vertically. The absence of any material obstacle, for example obtained using hollows or notches in the case of "solid" forms, allows, in particular due to the close fit of the two leg pieces against each other, the least thickness necessary to be provided both for the introduction phase into the boot and for the removal.

The different pieces are put in their positions after the introduction of the front leg piece in the boot, which serves as a support to allow the back leg piece to be put in its position by displacing the back leg piece via a downwards-rotational movement, separating the two leg pieces.

Immobilized in a preferably horizontal position, the compressible elements which are at least partly compressed, provide the pieces with the necessary tension for shaping the boot by preventing any folding, from the vamp to the leg of boot, while respecting its curves and lines.

The prominent shape of the heel which the back leg piece preferably has at its base ensures that the pieces are securely fixed, since it opposes any sliding of the said piece resulting from the pressure of the compressible elements.

During the removal phase, the traction on the back leg piece brings about the upwards rotational movement of the rear articulation and the decompression of the compressible element or elements which fold up diagonally inside the notches provided in the absence of any material obstacle in order to bring the two leg pieces closer together.

The two leg pieces which have been brought closer together produce the smallest thickness and provide the necessary space inside the boot for the user to proceed with the easy removal of the foot piece from the vamp.

In order to keep the inside of the boots hygenic, the boot trees are preferably fitted with an aeration system for the humidity which is caused by the foot sweating. This device is composed for example of channels, in particular two, the ends of which are common and which, hollowed out in the supporting base of the first piece, are responsible for conducting the humidity in order to evacuate it outside the boot.

The boot trees can be stored in a box and/or packing case by pivoting the foot piece which is placed under the supporting base of the front leg piece.

Supports can accompany the boot trees and will provide them with a staggered position. They are represented in the shape of a toeless sole fitted with a bevelled heel, and they can be provided with three surfaces of different levels which receive the supporting bases of the pieces. A vertical rod or double rod arranged on the edge of the surface of the support heel can be introduced between the lower and upper compressible connections linking the back leg pieces, and serves as a support for the third piece to articulate the previous pieces while preventing them from sliding.

When the pieces are staggered in this way on their supports, the features of the boot trees can be appreciated.

BRIEF DESCRIPTION OF THE DRAWING

According to particular embodiments, the tip of the foot piece could be designed in various shapes in order to enable the boot trees to be adapted to any type of boot.

The invention will be better understood if reference is made to the drawings attached hereafter, in which:

FIGS. 1, 2 and 3 represent views of the device according to the invention.

The above figures relate to an example made of plastic or solid wood, or of moulded plastic according to the forms indicated.

DESCRIPTION OF THE PREFERRED EMBODIMENTS

In keeping with the preceding discussion, in the following description and claims "hinge" refers to a single-pivot mechanical connection, and is distinguished from "link", which herein means a mechanical connection with more than one pivot.

Figure 1:
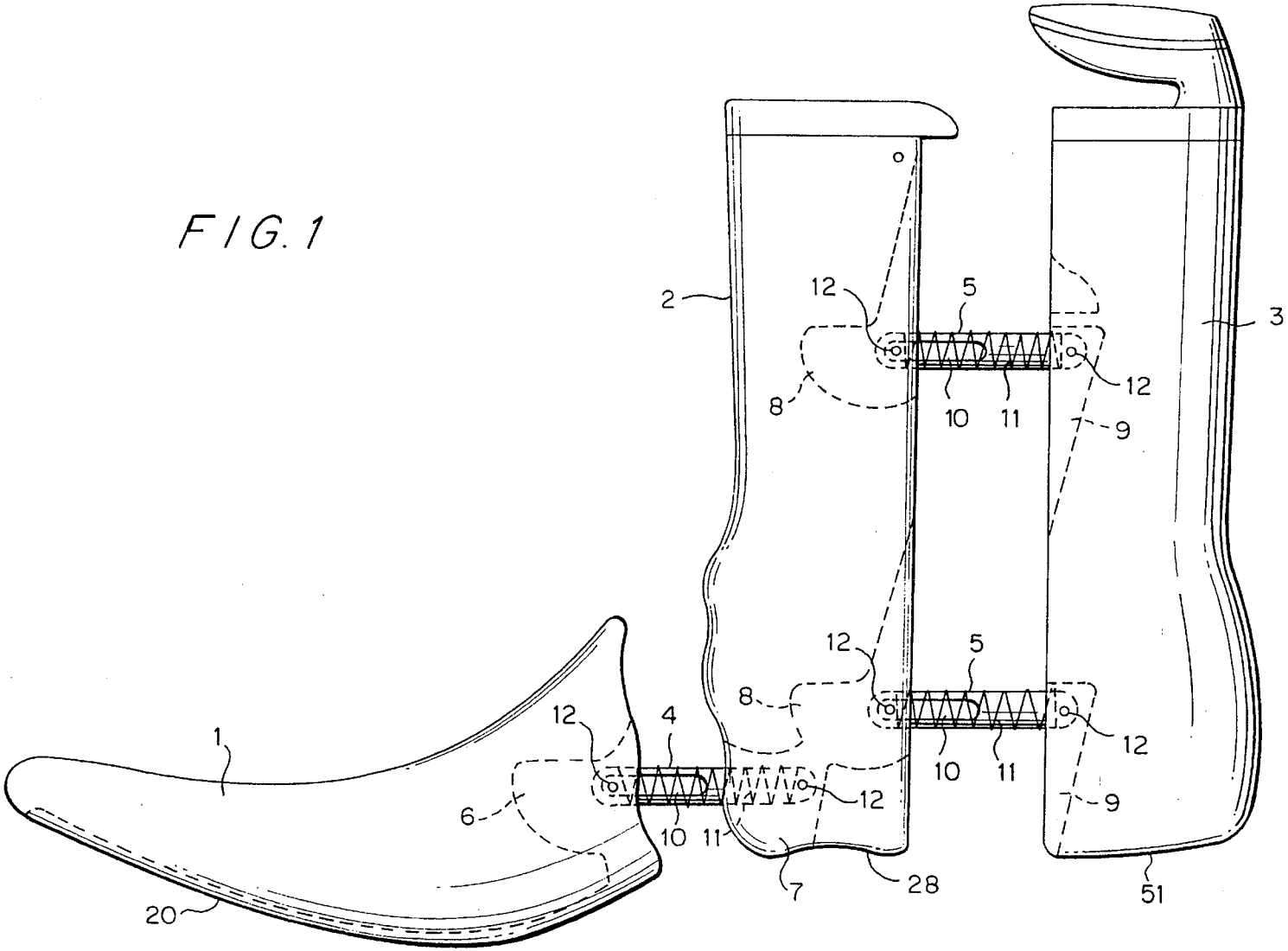

With reference to these drawings, and according to FIGS. 1, 2 and 3, this device comprises three shaped pieces 1, 2 and 3, articulated between each other by six articulated compressible linking elements, here metal tubes 5 of which the first two 4 placed opposite each other, connect the accommodating cavities 6 to the hollows 7 in order to form the front articulations. The four other tubes 5, arranged in pairs one above the other, connect the accommodating cavities 8 to the notches 9, to constitute the rear articulations of the pieces. These tubes 4, 5 have slots 10 at one of their ends and are fitted with a spring 11 and are connected to the shaped pieces by six metal fixing pins 12 placed widthways in the pieces, three of which pass right through the slots to facilitate the sliding of the tubes 4, 5, and compress their springs 11 placed between the pins 12. The rounded ends of the tubes can allow better movement.

Figures 4, 5, 6:
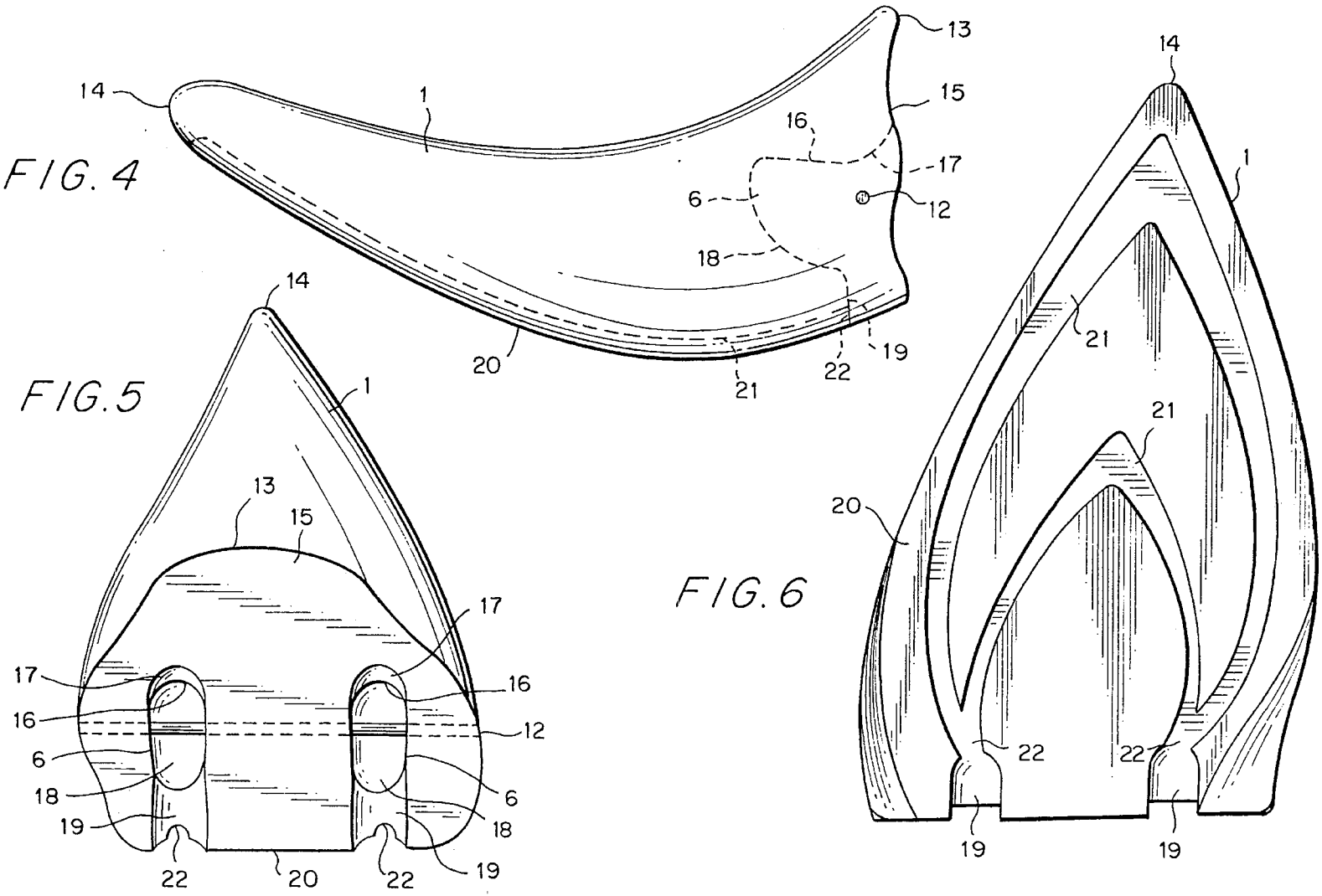
FIGS. 4, 5 and 6 represent views of the first shaped piece or foot piece.
Figure 10:
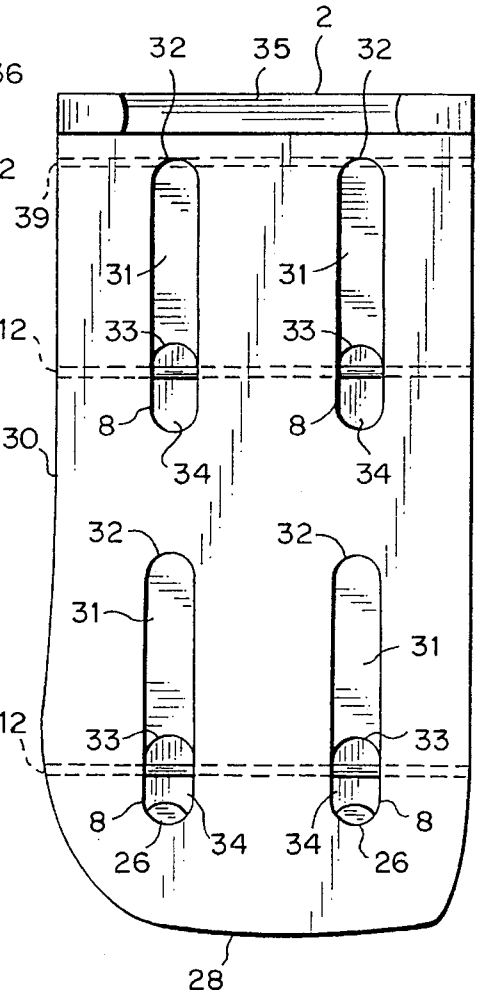
FIGS. 7, 8, 9 and 10 represent views of the second shaped piece or front leg piece.
Figure 9:
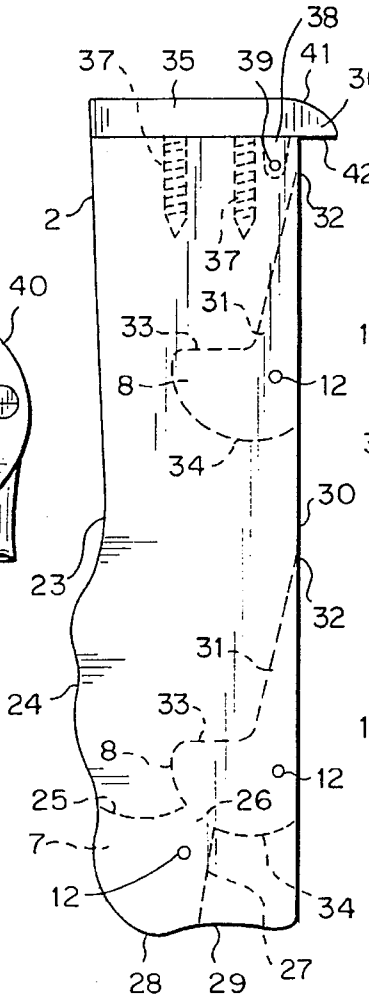
Figure 8:
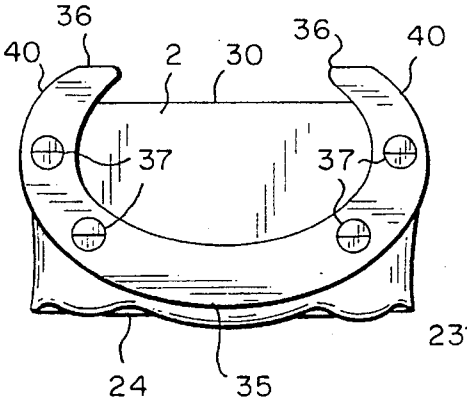
Figure 7:
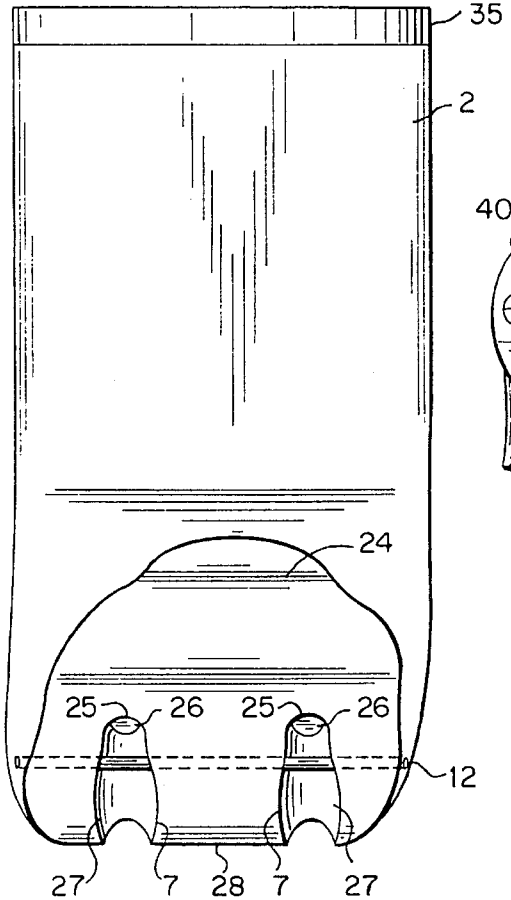

According to FIGS. 4, 5 and 6, piece 1 with a raised top 13 and with a long, curved profile finishing in a point 14 at the toe of the foot, has a curved inner surface provided with two identical, symmetrical and parallel accommodating cavities 6 the inclined top of which 16 has a convex opening 17, to facilitate the positioning of the front articulations 4, and the concave inside 18 hollowed out in the shape of an arc. At each of the bases, a notch 19 is provided opening out onto the supporting base of the piece, the fixing rod 12 passes horizontally through the entrance of the accommodating cavities. On the supporting base 20, two lower and upper channels 21 with common ends 22 are hollowed out, connecting each notch 19 and they have a similar shape to that of the supporting base.

According to FIGS. 7, 8, 9 and 10, piece 2 which has a high, rounded and splayed line, has a slight curvature 23 which means that it fits well with the instep of the boot; underneath, the inner surface 24 is curved inversely to fit the contour of surface 15 of piece 1. On this is found two hollows 7 of conical shape, approximately identical and overall parallel, the convex top 25 of which extends through an orifice 26; these hollows have inclined inner sides 27 which open onto the supporting base 28 which has a curvature 29. The back part of the front leg piece 2 is denoted by numeral 30.

This curvature 29 is necessary for certain styles of boots called cowboy boots for adjusting the piece on the high waist of the boot, which is the curved part between the sole and the heel, and which for these styles of boots is pronounced because a metal and/or plastic strip called a shank is introduced in this position.

The fixing pin 12 passes horizontally through the inside of the hollows 7.

In the flat inner surface of piece 2, four elongated notches 31, approximately identical and arranged in pairs one above the other, open upwards. They are obliquely hollowed out in the surface from their tops 32 and correspond at their bases with the top 33 of the accommodating cavities 8, the inside of which 34 is arc-shaped.

The lower accommodating cavities 8 have the specific feature of communicating with the hollows 7 via orifices 26.

At the top of piece 2, there is a piece 35 in the shape of a horseshoe, for example of metal, the ends 36 of which project outwards and form two protuberances 36. This piece is fixed by four screws 37, and has fastenings 38 introduced into the top of the front leg piece 2, kept in place by a fixing pin 39, positioned widthways and allowing a very effective fastening to be obtained.

The ends 36, whose edges 40 are reentrant, have a sloped upper part 41, curved downwards to the flat base 42, or itself also slanted in the same direction.

The two superimposed fixing pins 12 pass horizontally through the entrance of the accommodating cavities 8.

Figure 13:
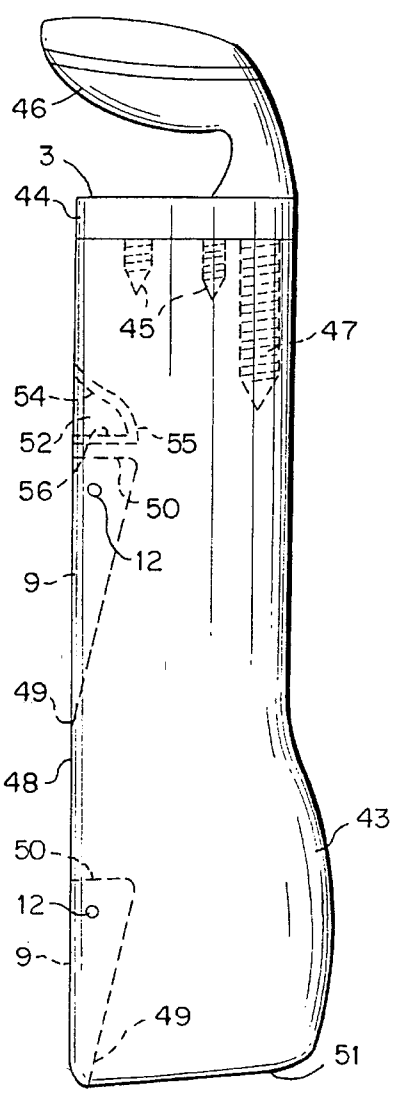
FIGS. 11, 12 and 13 represent views of the third shaped piece or back leg piece.
Figure 12:
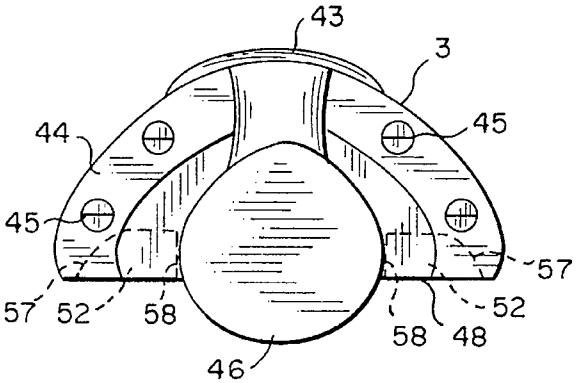
Figure 11:
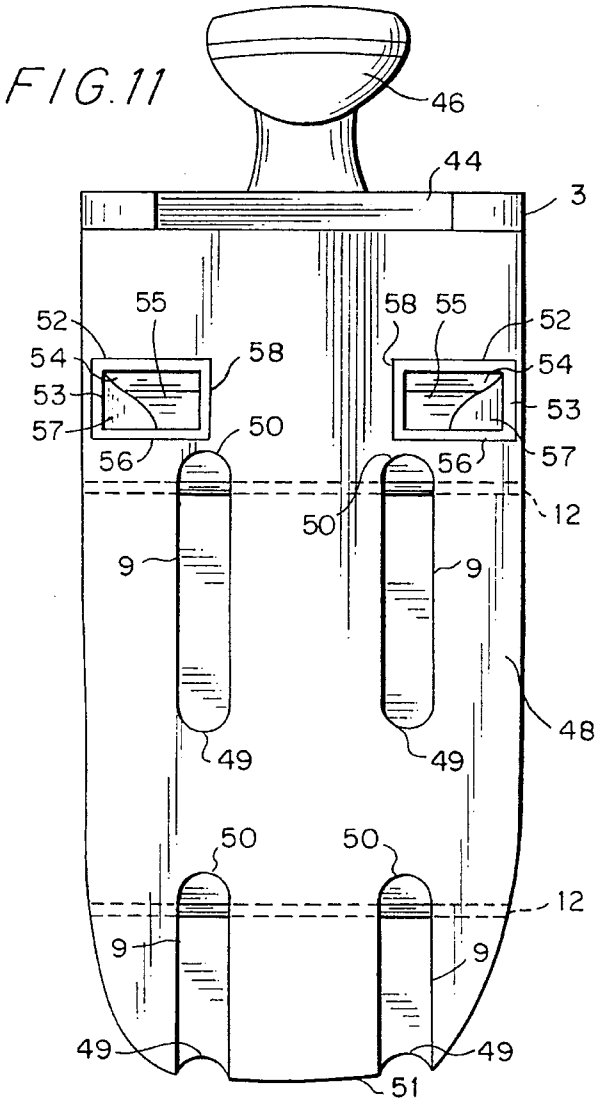

According to FIGS. 11, 12 and 13, piece 3, which is also high, rounded and splayed, has a heel 43 at its base which has a prominent shape; a metal piece 44 in the shape of a horseshoe is fixed on its top with four screws 45 and is surmounted by a knob 46 whose fixing screw 47 is integrally anchored inside piece 3.

This knob, being the boot tree handle, is shaped so that it comfortably fits the user's hand.

In the flat inner surface 48, four symmetrical, elongated notches 9 placed in pairs one above the other are also open upwards and are obliquely hollowed out from their bases 49, forming an acute angle at their tops 50.

The lower notches 9 are partly open on the supporting base 51 and the two superimposed fixing pins 12 pass through the top 50 of the notches.

Above the upper notches 9 and delimited by each edge, two rectangular-shaped metal reinforcements 52, with projecting borders 53, are embedded in the piece. These, whose opening 54 is curved and slanted at the top, extend via an inner part 55 whose rounded shape continues as far as the flat base 56 which is also optionally slanted in the same direction. Each of their outer sides 57 is curved, while their inner sides 58 are straight.

These cavities, intended to receive the ends 36 of the piece 35 in the shape of a horseshoe, are preferably made of metal or metal plates to be effective while protecting the surface into which they introduced. An advantage is that they are replaceable if they become worn.

The three pieces being thus constituted, their accommodating cavities 6, 8, the hollows 7, their notches 31, 9 are designed according to the size of the tubes 4, 5 as well as their cylindrical shapes.

The curved surfaces 15, 24 of pieces 1 and 2 have been chosen from an aesthetic point of view.

Pieces 2 and 3 occupy, due to their height, half of the leg of the boot, while covering two thirds of its area.

As boot trees are used in pairs, each element of the pair is suitable respectively for the right and left boots and is used in an identical way. One of them being for the style of boots with bevelled heels, which has a so-called chisel-toe will therefore be taken as an example for the different steps of their uses.

Figure 14:
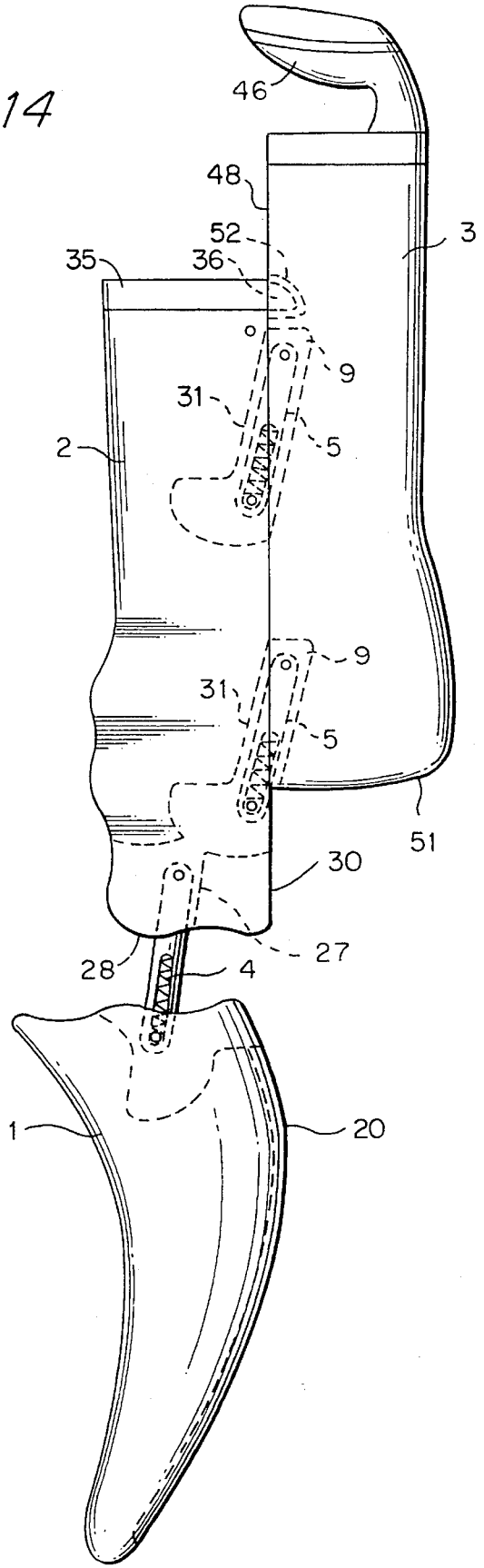
FIG. 14 represents a view of the vertical placement of the boot tree on a support.
Figure 15:
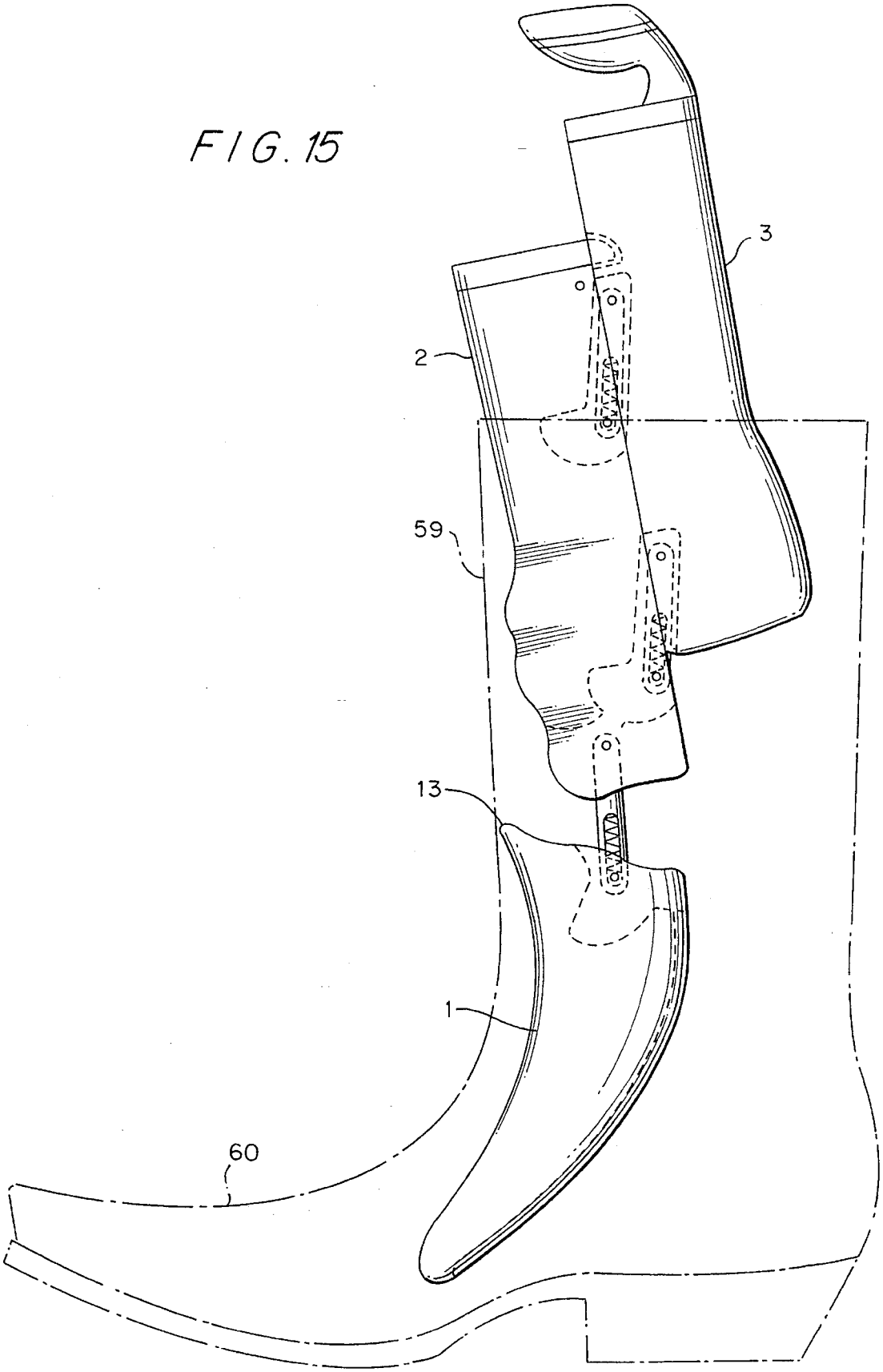
FIGS. 15 and 16 represent the phase of introducing the boot tree into the boot.
Figure 16:
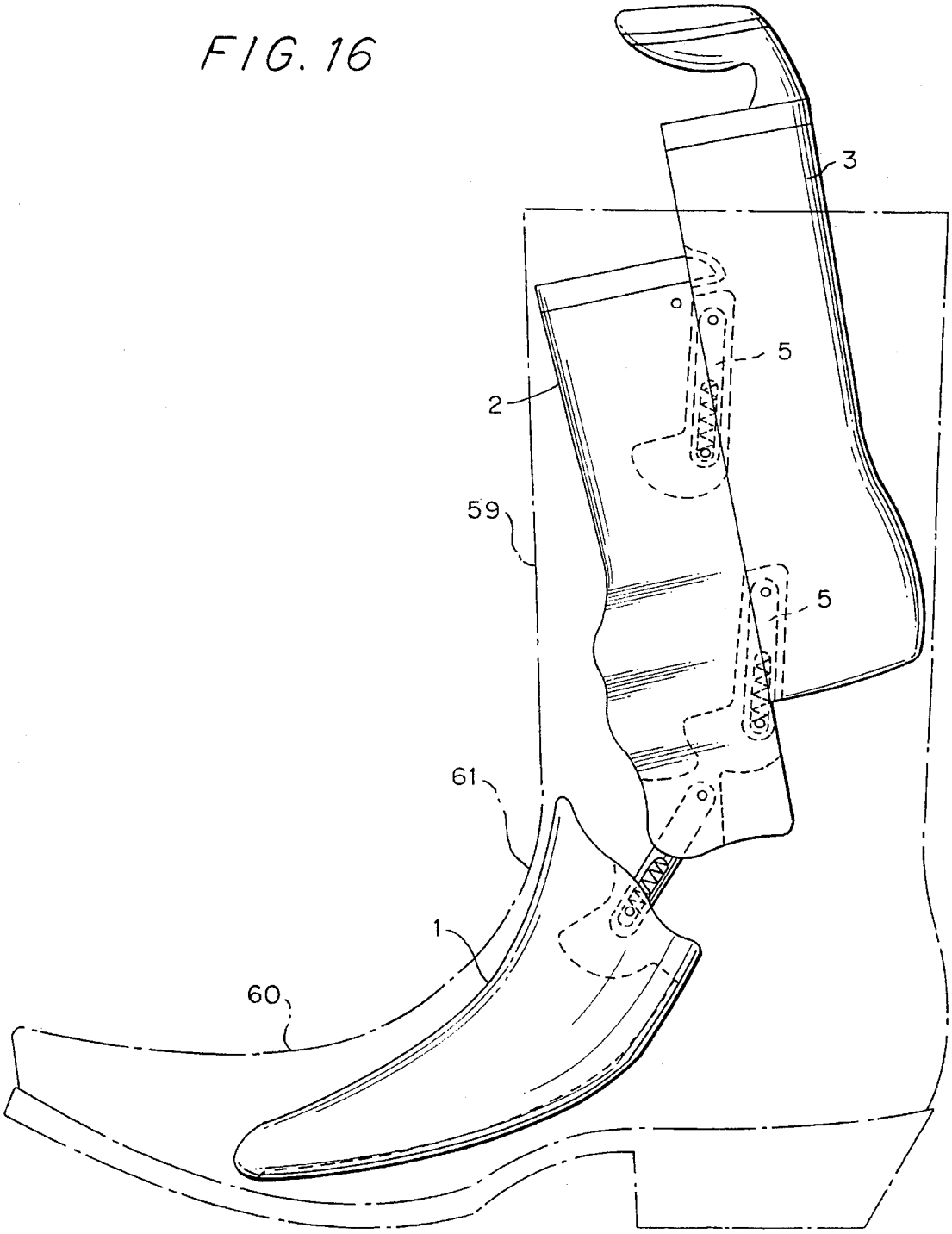

According to the figures, as the areas of the supporting bases 20, 28 and 51 of pieces 1, 2 and 3 are large when their front and rear links 4, 5 are in the horizontal position, with their springs 11 extended, it is essential to position them vertically in order make them as thin as possible to proceed with the phase of introduction into the boot, as illustrated in FIGS. 14, 15 and 16.

The user, by exerting traction on the knob 46, is able to raise piece 3; this moves the rear links 5 rotationally upwards, forcing them to be folded inside the notches 9, 31 to fit surface 48 of piece 3 against surface 30 of piece 2, and to produce the diagonal housing of said articulations.

When piece 3 is elevated, the oblique and inverse configuration of its notches 9 relative to the notches 31 produces, once pieces 2 and 3 come together, compartments for housing the rear articulations 5.

As surfaces 30, 48 are flat, they fit closely together and the openings of the lower notches 9 on the supporting base 51 are necessary for the positioning of the lower rear articulations 5.

The ends 36 of the horseshoe 35 are introduced into their respective cavities 52.

By raising pieces 1 and 2 in this way, the user enables piece 1 in its turn to be positioned vertically below the supporting base 28 of piece 2. Its projecting position is obtained from the sides 27 which tend to slant the front articulations 4.

Then, and according to FIG. 15, the user proceeds to introduce pieces 1, 2 and 3 into the boot.

The top of piece 1 slides against the front side of leg 59 and is positioned at the entrance of the vamp 60, pieces 1 and 2 being slightly inclined at the top of said leg.

According to FIG. 16, the circular sliding of piece 1 around the instep 61 of the boot to introduce it into the vamp 60, brings about the tilting of pieces 2 and 3 which are positioned diagonally on the front and rear sides of the leg 59.

Their position will have the effect of facilitating the introduction phase, taking account of the fact that the user will bear on leg 59 to introduce them while controlling the positioning of piece 1 by pushing.

This will also guard against possible separation of the two pieces, which would release the rear links 5 thus preventing the introduction.

Figures 17, 17A:
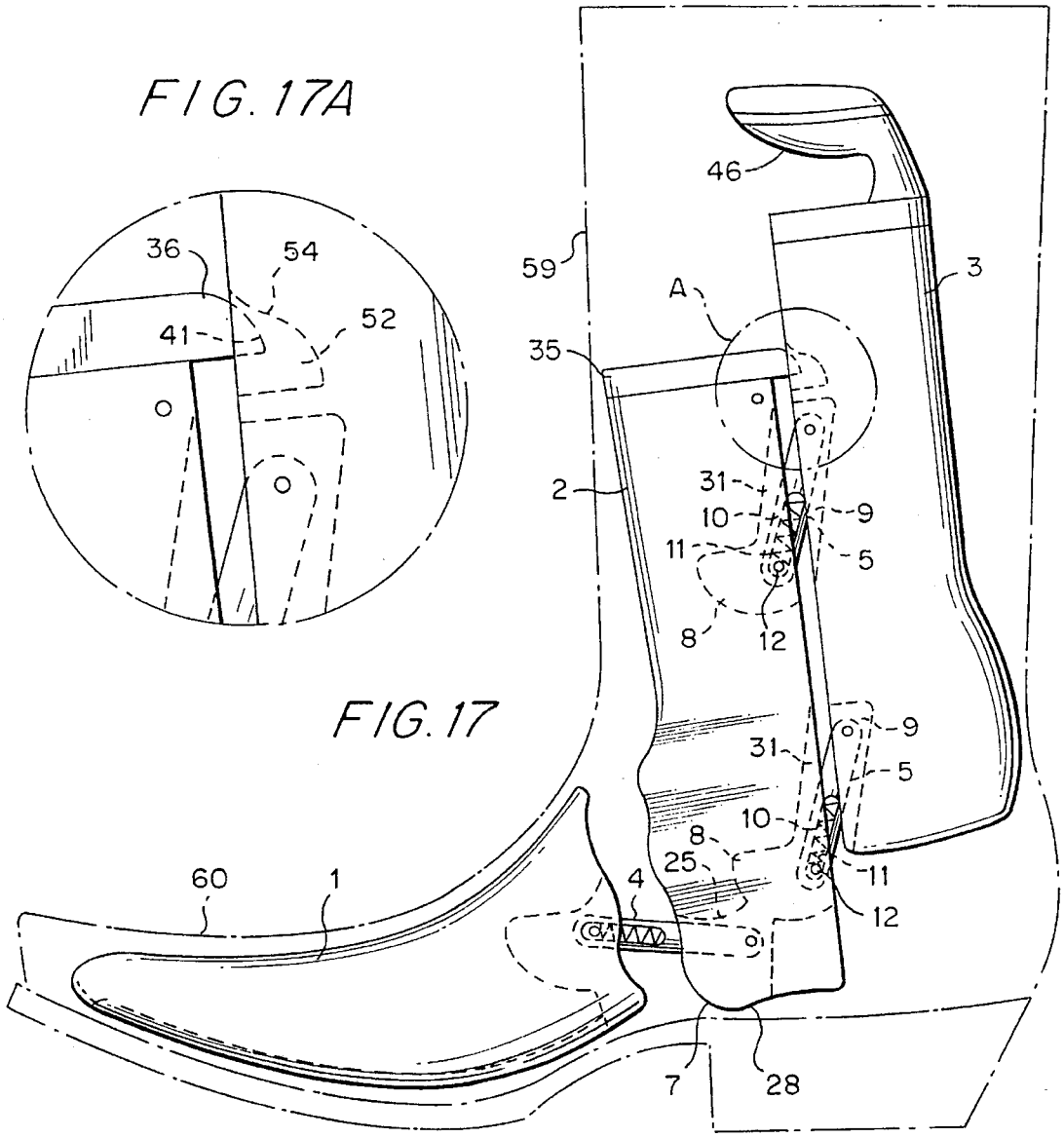
FIG. 17 represents the opening phase of the safety device of the boot tree.
FIG. 17A is an enlarged view of the circled area A in FIG. 17.

According to FIG. 17, once piece 1 is introduced inside the vamp 60, and piece 2 is inclined against the front side of the leg 59, its supporting base 28 is set down thus providing the necessary support for the opening phase.

The curved top 25 of the hollows 7, blocking the front articulations 4 by coming into contact with them, has the specific feature of preventing a pronounced inclination of the piece, which would be detrimental to the progress of the said phase.

As the user has enough space, his pushing on the knob 46 causes the ends 36 of the horseshoe 35 to slide from their cavities 52 thus providing a momentum to piece 3, in order for it to be separated from surface 30 and introduced into its position.

As shown in FIG. 17A, the sliding of the ends 36 vis-à-vis the cavities 52 is facilitated by the contact of the inclined top 54 of the cavities on the upper part 41, which is also inclined, of said ends. This action is even more simplified if a slight compression of the springs 1i of the rear articulations 5 is produced. A lubrication system such as Teflon® is placed on these surfaces.

When piece 3 slides, it releases the rear links in order to unfold them from the notches 9, 31; these rotate downwards and separate the two pieces by decompressing. The surface of leg 59 opposes an extension and the rear linking tubes 5 slide via their slots 10 on the fixing pins 12 in order to compress their springs 11 while being introduced into the accommodating cavities 8. Their horizontal advancement leads to a compression of the springs 11 applying pieces 2 and 3 against their respective sides.

The putting into intimate contact of piece 2 against the front side of leg 59, its supporting base 28 arranged by its curved shape 29 on the waist 62, causes the compression of the springs of the front linking tubes 4 which, being introduced into the accommodating cavities 6, allow the complete insertion of piece 1 inside the vamp 60.

The final positioning of piece 3 immobilizes the rear linking pieces 5 in the horizontal position.

Figure 18:
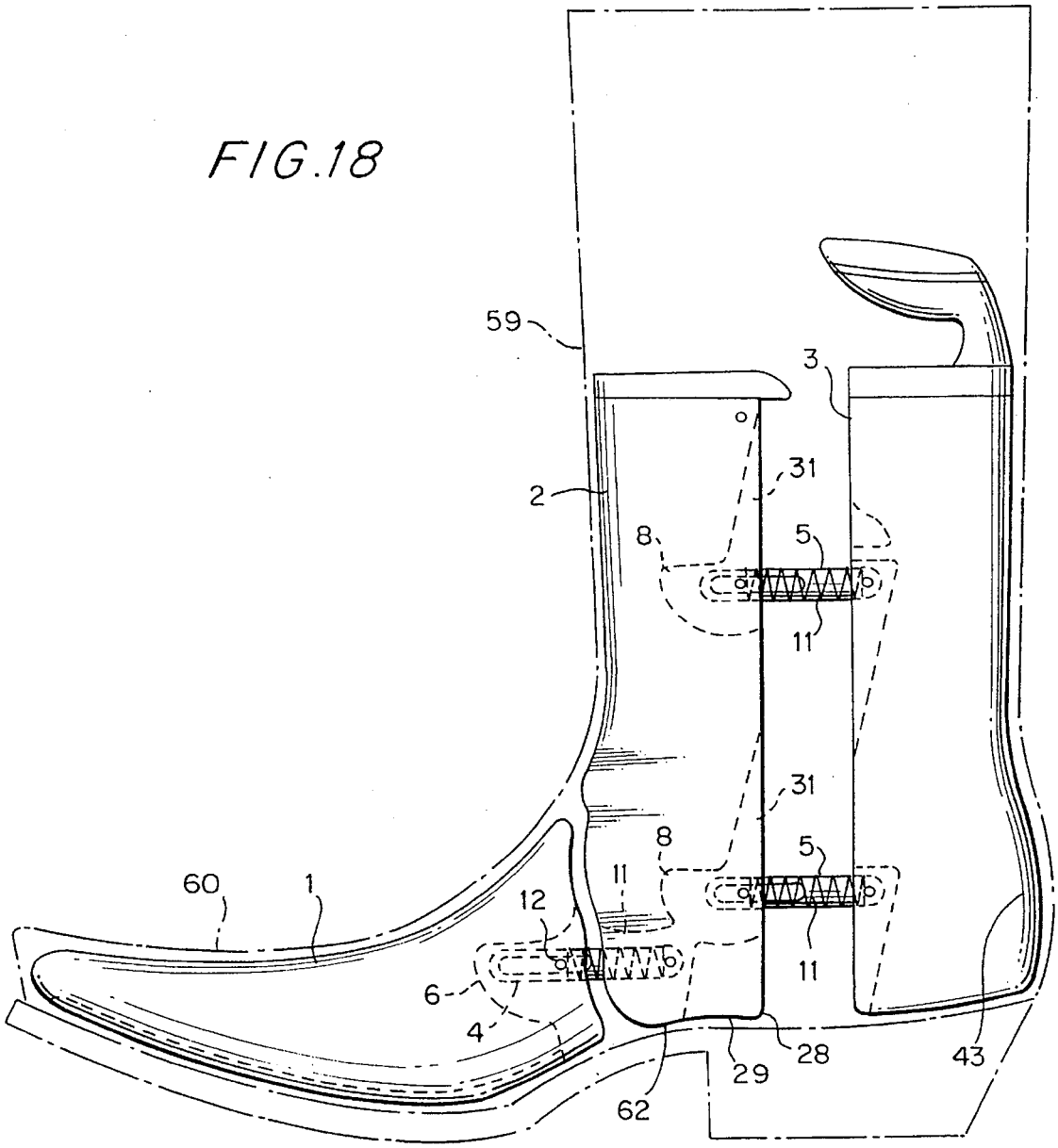
FIG. 18 represents the fixing of the boot tree inside the boot.

According to FIG. 18, piece 1 is inserted in the vamp 60, piece 2 is against the front side of leg 59, its curved supporting base 28 is on the waist 62 and piece 3 fits closely from its heel 43 as far as the back side of said leg, the three pieces constituting this boot tree are solidly installed inside the boot.

The tension produced by the springs 11 of the articulations 4, 5, housed in their accommodating cavities 6, 8 in a horizontal position, allow the three pieces to firmly stretch the leather of the boot from the vamp 60 to the leg 59, keeping this upright, while respecting its curves and lines.

The arrangement of the accommodating cavities 6, 8 at the base of the notches 31 produces, when the rear articulations 5 rotate downwards, the separation of pieces 2 and 3 so as to fix the boot tree in place in a single movement.

In fact, these cavities are rounded, and their diameter relative to the shaft 12 is approximately equal to the length of an element 4, 5 between its rounded end provided with slots and the end of said slot situated towards the rear.

The linking elements 4, constituted by pairs of tubes, give a better distribution of the forces of their springs 11, when the boot tree is fixed in place.

The heel 43 has the specific feature of being a means of securely fixing the boot trees, because its prominent shape will prevent the sliding of piece 3 as a result of the force produced by the springs 11.

Figure 19:
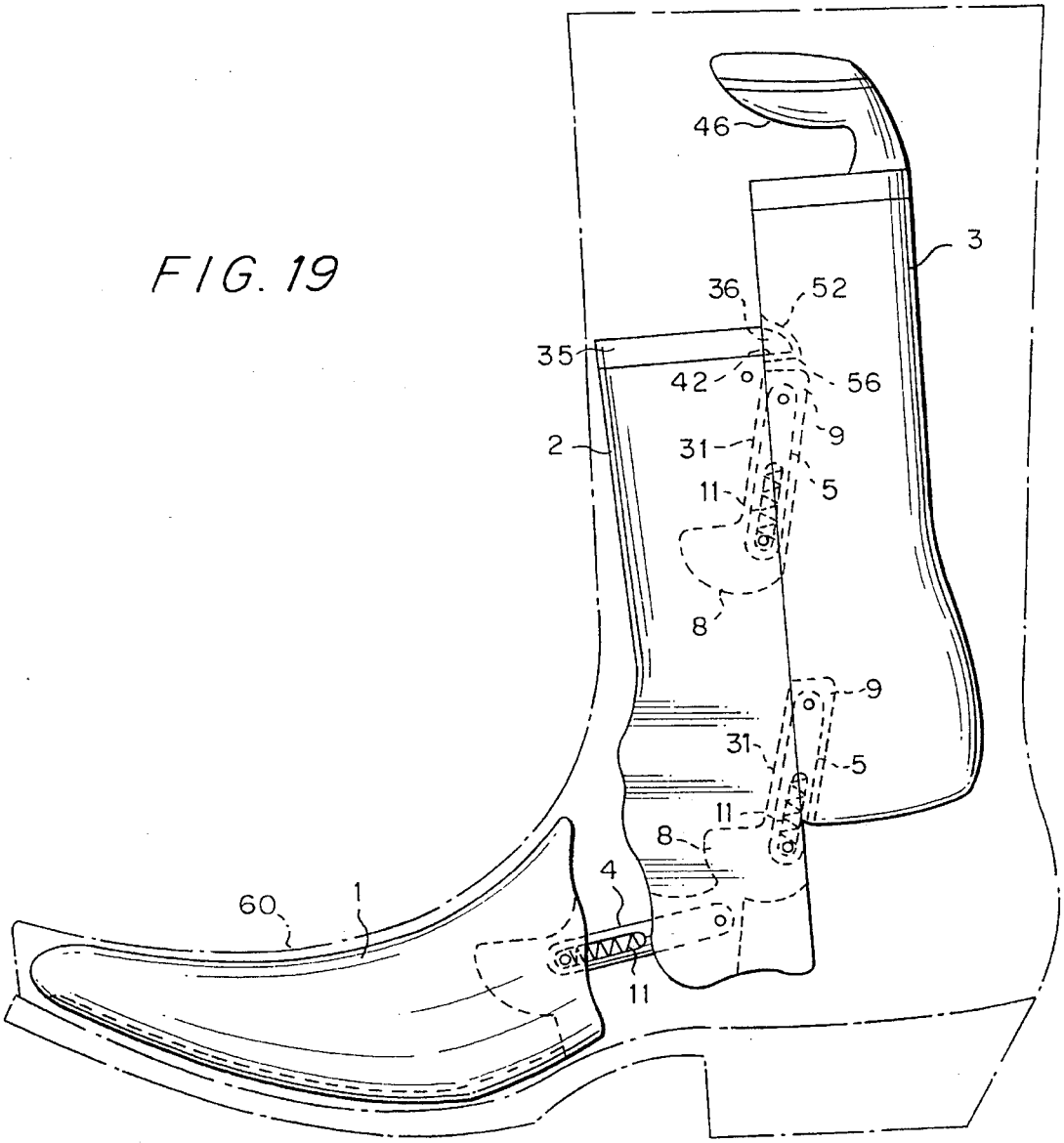
FIGS. 19 and 20 represent the removal phase of the boot tree.
Figure 20:
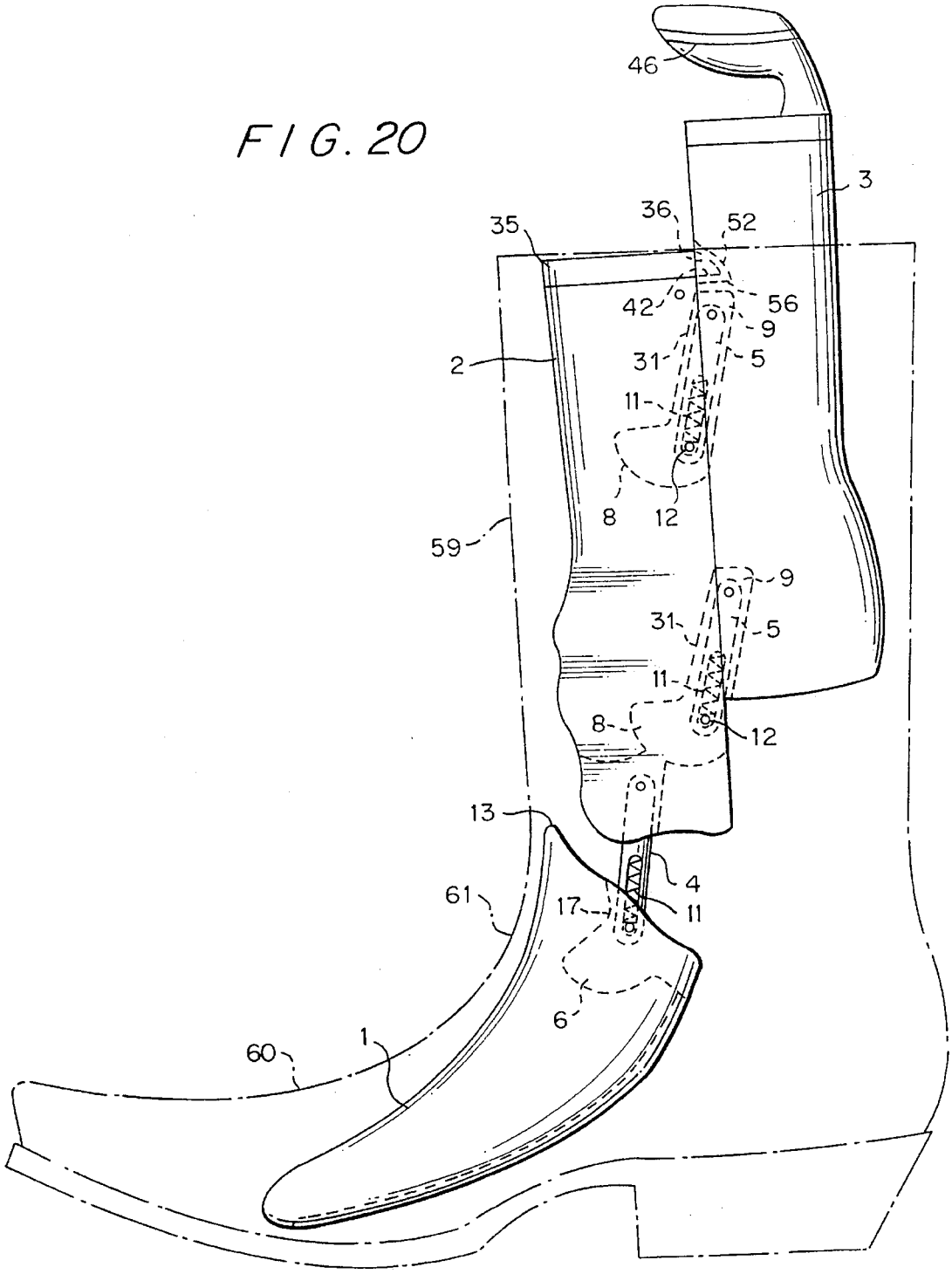

According to FIGS. 19 and 20 showing the removal phase, pieces 2 and 3, by fitting closely to each other, make the boot tree thinner. The user, removing piece 3 by exerting traction on the knob 46, raises it up in order to lift it from the side of the leg.

This again makes the rear linking elements 5 rotate upwards which, by leaving their accommodating cavities 8, bring about the decompression of their springs 11, thus facilitating the raising of the said piece.

The rear linking elements 5 are then arranged in a diagonal position in the notches 31, 9 which form their compartments.

The positioning of the protuberances 36 inside the cavities 52 ensures during this phase that the pieces are safely removed while preventing direct stress being applied to the rear links 5 which could be damaged by the tractive forces.

This safety is obtained by the hooking of surface 42 of the ends 36 on surface 56 of the cavities 52. As has been seen, if these surfaces are slanted an even better hooking action is produced.

The front links 4 are also dislodged by decompression of their springs 11, and the user, by removing pieces 2 and 3, proceeds with the removal of piece 1 from the vamp 60.

This, with its top 13 sliding around the instep 61, facilitates the positioning of the front links 4 due to the convex opening 17 of the top of its accommodating cavities 6. Pieces 2 and 3 having advanced to the top of the leg 59, produce the final removal of the boot tree. The different rotational movements of the rear links 5 are carried out via the shafts formed by the two fixing pins 12 of piece 2.

Figure 21:
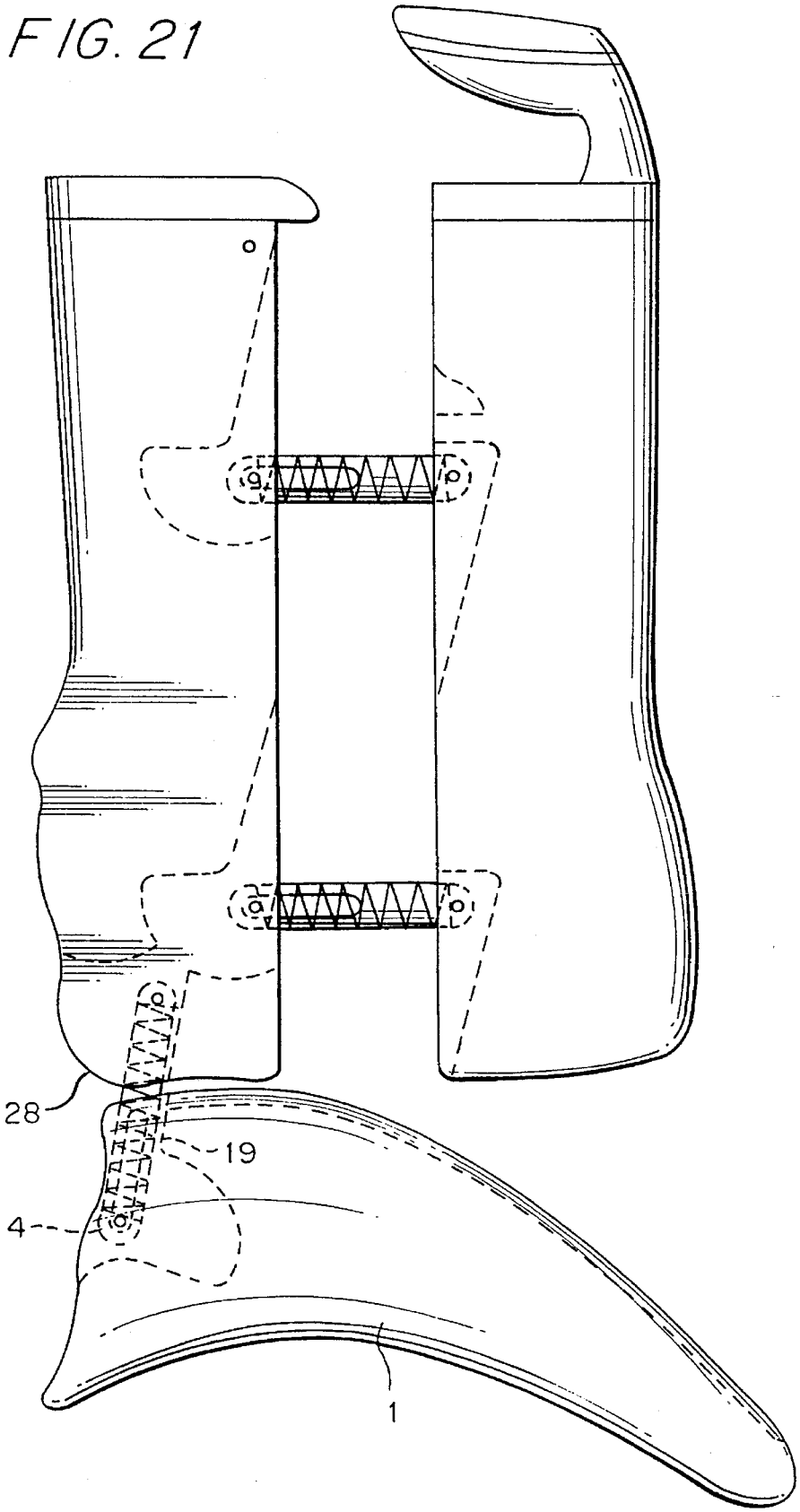
FIG. 21 represents a view of the storage position of the boot tree.

According to FIG. 21, these boot trees have a storage position for fitting them into a box and/or packing case; it is sufficient to position piece 1 vertically, the front links 4 being sufficiently long, and to pivot it under the supporting base 28 in order to place it in the storage position.

This positioning is possible due to the notches 19 which allow link 4 to rotate through almost 180°, the other extreme position being limited by surface 17.

In order to keep the inside of the boots hygienic, the boot trees are provided with an aeration device for the humidity which is caused by the foot sweating.

It is composed of two lower and upper channels 21, the common ends 22 of which, connecting the notches 19 of piece 1, are responsible for conducting the humidity in order to evacuate it via the orifices 26 of piece 2 to the outside of the boot.

Figure 24:
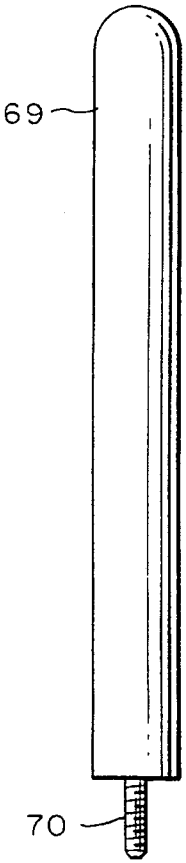
FIGS. 22, 23 and 24 represent views of the boot tree support.
Figure 22:
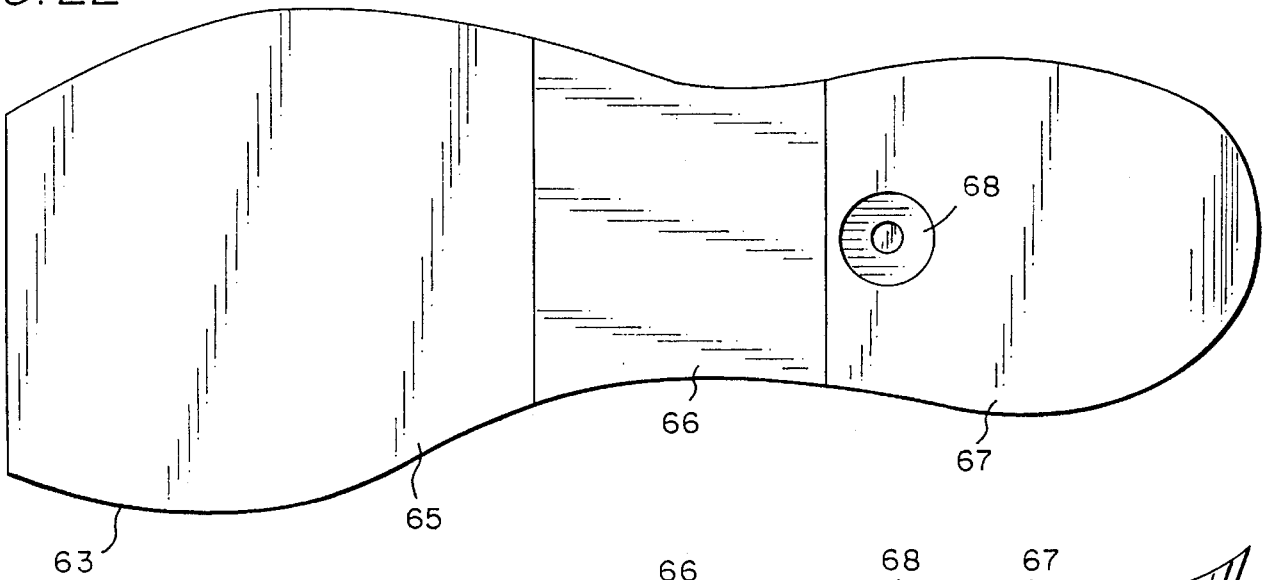
Figure 23:
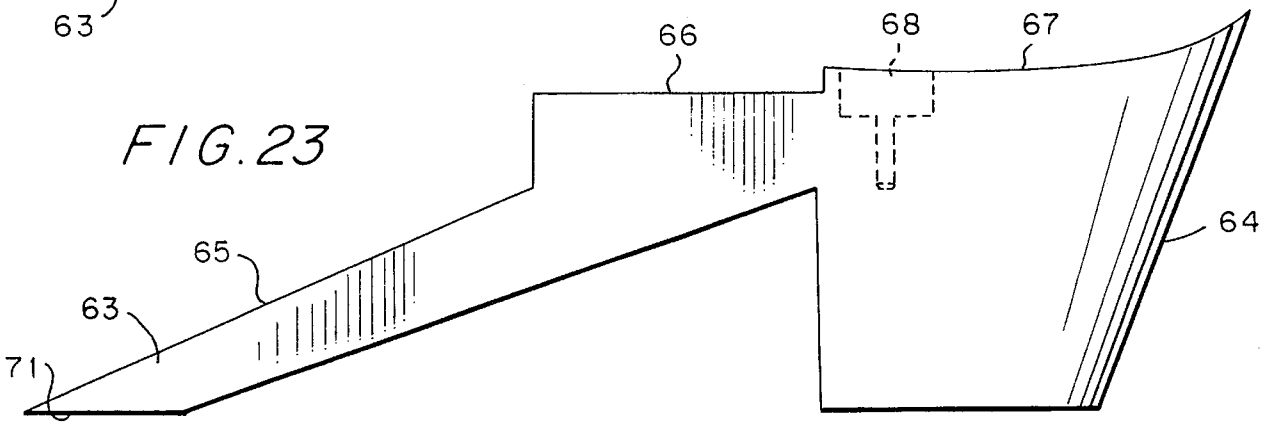

According to FIGS. 22, 23, 24 the boot trees will be accompanied by supports.

They are constituted by two parts, the first of which represents the shape of a sole 63 fitted with a bevelled heel 64. This is toeless and slanted and comprises an inclined and flat surface 6 for the supporting base, and a second surface 66 also flat and straight, on a higher level, for the supporting base 28. The surface 67 of the heel 64, slightly higher, is hollowed out to allow piece 3 to be well seated.

In the centre of the edge of surface 67 an opening 68 is provided to receive the second piece, represented by a cylindrical rod 69 the screw 70 of which allows the said rod to be fixed in place.

Figure 25:
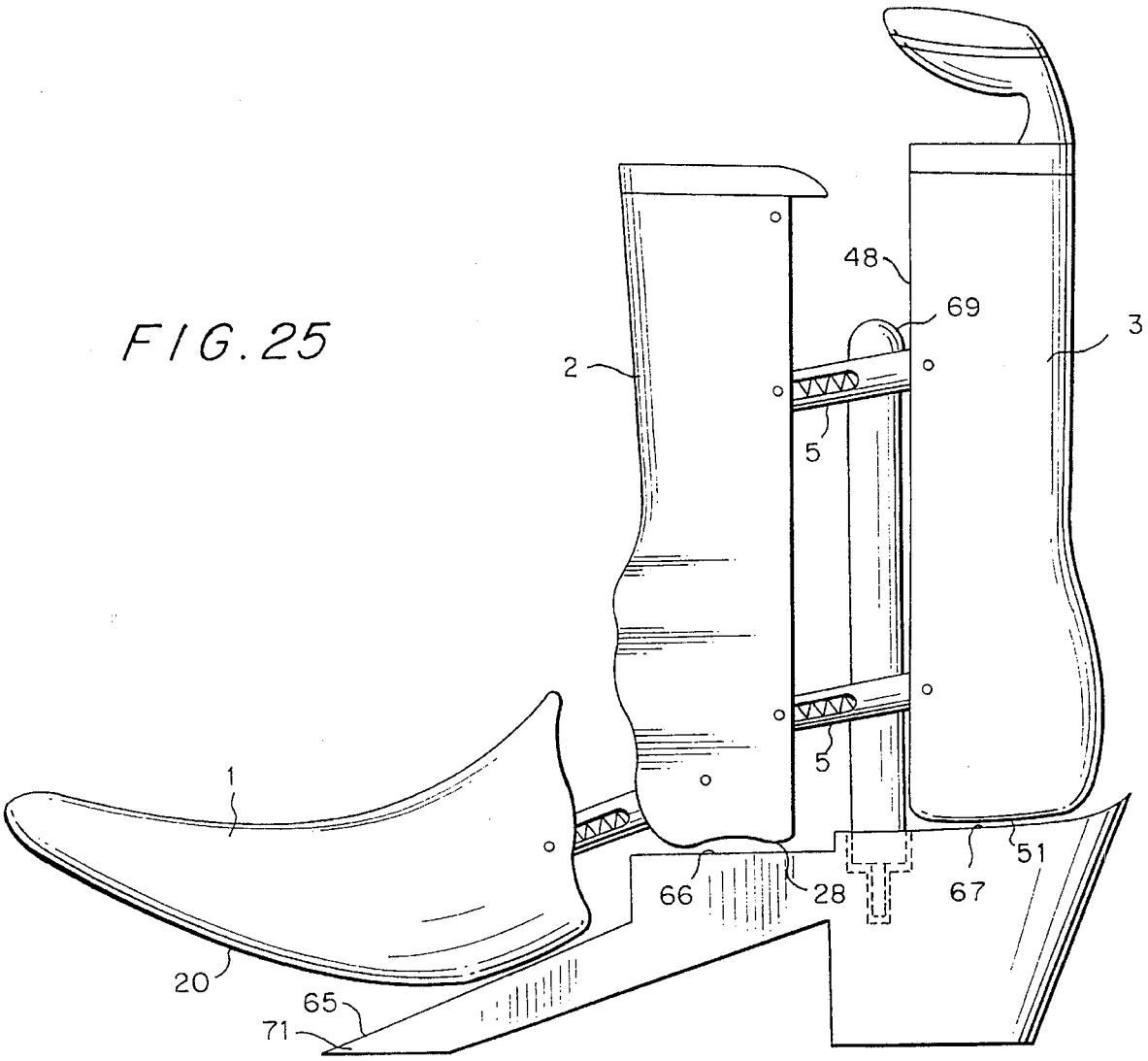
FIG. 25 represents a variant of the boot tree on its support.

When the user slides this rod 69 between the lower and upper rear double links, it will be possible for piece 3, once it has been positioned, to rest against the rod via its surface 48, thus articulating pieces 1 and 2 on their surfaces 6, 66 while preventing them from sliding. The supporting base 71 is bevelled so that the support is well balanced. According to FIG. 25, representing a variant of the boot tree on its support, the staggering of pieces 1, 2 and 3 on their surfaces 6, 66 and 67, allows the features of the boot trees to be appreciated.

The foot piece constituting the support is made of a single element and could be covered with a material for protecting the supporting bases 28 and 1.

The boot trees according to the invention are easy and effective to use and can be remarkably attractive.

These boot trees as well as their supports can be made of metal, plastic and preferably wood.

The device according to the invention is particularly well-suited to boots with bevelled heels.

A man skilled in the art will have no difficulty in making the necessary adjustments for use, for example hollow forms instead of solid and hollowed out shaped pieces, by providing reinforcing ribs, fingers to maintain the shafts such as the pins 12; the notches, hollows, accommodating cavities correspond to the absence of material in the case of a hollow example.

In the case of hollow forms, there could be a continuity between pieces 2 and 3, thus hiding the mechanisms. For this the diameter of the front or back leg piece must be slightly smaller than that of the other piece, the outer shaped edges sliding together all along its length. In this case, one or several stops will be provided, for example produced in the leg piece which has the larger diameter, to limit the relative rotation of the two pieces. There is therefore no real close fit of one piece against another, but only an equivalent position.

The protuberances 36 and the corresponding cavity 55 could be provided at any level, at the top of pieces 2 and 3 as illustrated above, or at lower levels, for example and preferably at least at the middle level between the two linking pieces 5 illustrated above.

As has been seen, instead of solid pieces, shapes can be produced by moulding the shape of solid pieces, for example so as to imitate wood, with less weight. The advantage relative to completely hollow shapes is the easier provision of surfaces such as surfaces 25, 27, 33, 34 and 54 and more generally the surfaces of the different cavities mentioned above. The protuberances 36 can be directly produced by moulding, as well as the corresponding cavities etc.

In fact, in the case of totally hollow shapes, roughly in the shape of a half-tube, it is necessary to provide for example supports for the shafts 12, the protuberances 36 or the corresponding cavity.

I claim:

1. A boot tree comprising:

a foot piece (1);

a front leg piece (2);

a back leg piece (3);

compressible linking elements;

a forward mechanical connection of the foot piece to the front leg piece, said forward mechanical connection including a hingeless forward linking element (4) of said compressible linking elements pivotally connected on each end thereof between the foot piece and the front leg piece and allowing relative pivoting backwards and forwards of the foot piece and the front left piece; the front leg piece including no material obstacle to obstruct pivoting of the foot piece between a resting foot position and a pointed foot position;

a rear mechanical connection of the front leg piece to the back leg piece, said rear mechanical connection including a hingeless rear linking element (4) of said compressible linking elements pivotally connected on each end thereof between the front leg piece and the back leg piece and allowing relative pivoting backwards and forwards of the front leg piece and the back leg piece; the front leg piece and the back leg piece including no material obstacle to obstruct pivoting of the front leg piece and the back leg piece between a natural heel position and a raised heel position;

means for limiting relative pivoting in a left-right direction of the front leg piece and the back leg piece;

means for limiting relative pivoting in a left-right direction of the foot piece and the front leg piece;

catch means for the rear leg piece to exert an upward traction on the front leg piece; said catch means further comprising a hook-shaped protuberance (36) on an inside of selectively the front leg piece and the back leg piece and a cooperating cavity (55) on another inside of selectively the back leg piece and a front leg piece facing thereto, said cavity being complementary in shape to the protuberance; whereby, the back leg piece pulls upwardly on the front leg piece, when the back leg piece is in a raised heel position, irrespective of upward forces of the forward linking element, the rear linking element, and the means for preventing relative pivoting in a left-right direction.

2. The boot tree according to claim 1, wherein the means for limiting relative pivoting in a left-right direction of the front leg piece and the back leg piece selectively comprises the rear linking element.

3. The boot tree according to claim 2, wherein the means for limiting relative pivoting in a left-right direction of the foot piece and the front leg piece selectively comprises the forward linking elements.

4. The boot tree according to claim 3, wherein at least one of the linking elements comprises:

a tubular element (4,5);

a transverse first shaft (12) passing through the tubular element at one end thereof;

two opposing longitudinal slits (10) at an opposite end thereof;

a transverse second shaft (12) disposed through the longitudinal slits;

a compressible element (11) disposed within the tubular element between the first shaft and the second shaft;

whereby a length of the longitudinal slits determines extreme contracted and extended positions of the one of the linking elements, and whereby the first transverse shaft and the second transverse shaft may while inserted through the one of the linking members link selectively the foot piece, the front leg piece, and the back leg piece by being fastened thereto and the compressible element acts to put the boot tree in contact with inside surfaces of a boot when the boot tree is emplaced therein and place tension upon the boot.

5. The boot tree according to claim 4, wherein one of the linking elements links the front leg piece to the back leg piece adjacent respective lower ends of the leg pieces, and another one of the linking elements links the front leg piece and the back leg piece adjacent respective upper ends of the leg pieces.

6. The boot tree according to claim 5, comprising three pairs of the linking element, and wherein one of the pairs couples the foot piece to the front leg piece and the other two pairs couple the front leg piece to the back leg piece.

7. The boot tree according to 6, wherein the protuberance (36) includes an upper protuberance face (41) and a lower protuberance face (42) creating a coupling, said upper protuberance face (41) being slanted towards a heel position.

8. The boot tree according to claim 7, wherein a depth of the cavity (55) is only slightly greater than a size of the protuberance (36), and the cavity includes a lower cavity face and an upper cavity face (54) creating a coupling, said upper cavity face (54) being slanted towards a heel position, whereby during introduction of the boot tree into a boot, a pressure exerted on the back leg piece causes said upper protuberance face (41) and said upper cavity face (54), which faces do not produce coupling, to slide against each other, separating the front leg piece and the back leg piece (2,3) from one another, thus facilitating the relative pivoting the front leg piece and the back leg piece.

9. The boot tree according to claim 8, wherein the foot piece is pivotable to a position under the front leg piece and the back leg piece, whereby the foot piece may be disposed under selectively the back leg piece and the front leg piece for insertion into a boot.

10. The boot tree according to 1, wherein the protuberance ( 36 ) includes an upper protuberance face ( 41 ) and a lower protuberance face (42) creating a coupling, said upper protuberance face (41) being slanted towards a heel portion.

11. The boot tree according to claim 1, wherein a depth of the cavity (55) is only slightly greater than a size of the protuberance (36), and the cavity includes a lower cavity face and an upper cavity face (54) creating a coupling, said upper cavity face (54) being slanted towards a heel portion, whereby during introduction of the boot tree into a boot, a pressure exerted on the back leg piece causes said upper protuberance face (41) and said upper cavity face (54), which faces do not produce coupling, to slide against each other, separating the front leg piece and the back leg piece (2,3) from one another, thus facilitating the relative pivoting the front leg piece and the back leg piece.

* * * * *